United States Patent [19]

Sakamaki et al.

[11] 4,367,036

[45] Jan. 4, 1983

[54] TEMPERATURE AND HUMIDITY COMPENSATING DEVICE IN AN IMAGE FORMING APPARATUS

[75] Inventors: Hisashi Sakamaki, Yokohama; Yoshimasa Kimura, Kawasaki; Toshio Honma, Tokyo; Ikuo Souma, Yokohama, all of Japan

[73] Assignee: Canon Kabushiki Kaisha, Tokyo, Japan

[21] Appl. No.: 93,854

[22] Filed: Nov. 13, 1979

Related U.S. Application Data

[63] Continuation of Ser. No. 865,690, Dec. 29, 1977, abandoned, which is a continuation of Ser. No. 655,245, Feb. 4, 1976, abandoned.

[30] Foreign Application Priority Data

Feb. 8, 1975 [JP] Japan ..... 50-16611

[51] Int. Cl.[3] ..... G03G 15/00

[52] U.S. Cl. ..... 355/14 R

[58] Field of Search ..... 355/14 R, 3 R, 3 FU, 355/3 DR, 133, 30; 219/216

[56] References Cited

U.S. PATENT DOCUMENTS

| | | | |
|---|---|---|---|
| 2,357,809 | 9/1944 | Carlson | 15/1.5 R |
| 2,902,974 | 9/1959 | Greaves | 355/3 DD |
| 3,349,221 | 10/1967 | Schulze et al. | 355/3 R |
| 3,519,253 | 7/1970 | Aser et al. | 219/216 X |
| 3,804,512 | 4/1974 | Komori et al. | 355/10 X |
| 3,848,988 | 11/1974 | Thettu et al. | 355/30 X |
| 3,977,782 | 8/1976 | Sakamaki et al. | 355/30 |

FOREIGN PATENT DOCUMENTS

| | | | |
|---|---|---|---|
| 45-21339 | 8/1970 | Japan | 355/3 DD |

*Primary Examiner*—Richard L. Moses

*Attorney, Agent, or Firm*—Fitzpatrick, Cella, Harper & Scinto

[57] ABSTRACT

A temperature and humidity compensating device is provided in electrophotographic apparatus including a photosensitive medium having a photoconductive layer, an image forming unit for forming an electrostatic latent image on the photosensitive medium, a heat source disposed near the photosensitive medium for heating the latter, a temperature detector disposed remotely from the heat source for detecting the temperature of the photosensitive medium, and control means for controlling the heating of the heat source so that the temperature of the photosensitive medium detected by the detector is not lower than the ambient temperature. Thus, the photosensitive medium may be prevented from deterioration due to falling temperature and moisture absorption, thereby permitting a normal image formation to be achieved.

19 Claims, 10 Drawing Figures

TEMPERATURE AND HUMIDITY COMPENSATING DEVICE IN AN IMAGE FORMING APPARATUS

This is a continuation, of application Ser. No. 865,690, filed Dec. 29, 1977, now abandoned; which in turn was a continuation application of Ser. No.: 655,245, filed Feb. 4, 1976, now abandoned.

BACKGROUND OF THE INVENTION

1. Field of the Invention

This invention relates to a temperature and humidity compensating device for preventing deterioration in image formation from occurring due to low ambient temperatures and high humidities in an apparatus for forming electrostatic latent images on the surface of a photosensitive medium having a photoconductive layer and a conductive layer.

2. Description of the Prior Art

Description will hereinafter be made by taking, as an example, an electrophotographic copying apparatus in which a photosensitive medium is exposed to a light image and a corona discharge to form thereon an electrostatic latent image which is in turn developed into a visible image.

In copying machines wherein a photosensitive medium having a photoconductive material is subjected to steps of charging, exposure development, etc., the important factors for providing a good quality image are the characteristics of the photosensitive medium, the corona discharge and the developer.

Electrophotographic copying machines are usually used in an environment which may contain one of various combinations of temperature and humidity, such as low temperature and high humidity, or high temperature and high humidity. Among these ambient conditions, low humidity offers no inconvenience to the sensitivity of the photosensitive medium and the corona discharger. However, in an environment containing either low temperature or high humidity, the following problems will be encountered.

At low temperatures below the normal temperature range of 15° to 20 C., especially below 10° C., the electrostatic latent image resulting from application of a light image to a photosensitive medium has its contrast decreased due to the properties of the electrons trapped in the photoconductive layer of the photosensitive medium. Further, the corona discharge current is decreased to reduce the discharging efficiency, thus further decreasing the contrast of the image. Also, where image development is carried out by the use of a liquid as a carrier, low temperature may induce a poor developing effect because a falling temperature reduces the mobility of the toner particles in the developing liquid. The result is a low contrast in the latent image which in turn leads to difficulties in providing the best quality of visible image.

If left under high humidity conditions for a long time, the photosensitive medium will absorb moisture and the resistivity thereof will thus be decreased. Such decreased resistivity, coupled with the well-known fact that the discharge current resulting from corona discharge is decreased at high humidity, decreases the contrast of the latent image and cannot promise a good quality of image. This will be apparent, for example, from the fact that, in the wintertime of a cold northern district, a copying machine adjusted to normal room temperatures of 20° to 25° C. cools down to the order of −10° C. at night (when the heating equipment in offices are turned off), and in the morning when the heating equipment is turned on, it takes much time for the interior temperature of the cold machine to rise up to substantially the same level as the room temperature and, in addition, dew drops are created on the surface of the photosensitive medium so that image reproduction of good quality is unobtainable during the early part of the office hours.

As a countermeasure for low ambient temperatures, a preheater has heretofore been provided in copying machines to prevent the interior temperature of the machine from falling below a certain level.

Nevertheless, there has been no countermeasure for protecting the performance of the copying machine not only against low ambient temperatures but also against an environment containing either or both of low temperature and high humidity, much less a countermeasure which can economically and safely sustain a subject to be minimally protected against the adverse ambient conditions.

SUMMARY OF THE INVENTION

It is an object of the present invention to prevent the characteristics of a photosensitive medium not only from deterioration under low temperature conditions but also from deterioration under high ambient humidity conditions, thereby ensuring that a good image formation will be achieved even if a copying machine or the like is left under various environmental conditions.

It is another object of the present invention to prevent the characteristics of the photosensitive medium from deterioration under low ambient temperatures and high humidities and also to prevent deterioration of the corona discharger used to form latent images on the photosensitive medium, thereby that a good latent image formation will achieved.

It is still another object of the present invention to prevent the characteristics of the photosensitive medium and corona discharger from deterioration under low ambient temperatures and high humidities and also to prevent deterioration of the developing liquid used for visualizing latent images, thereby ensuring a good image formation.

It is yet still another object of the present invention to employ a heat source and a temperature detector and to contrive their arrangement in a copying machine so as to prevent deterioration in the characteristics of the photosensitive medium, corona discharge and developing liquid rising the least number of necessary elements.

It is a further object of the present invention to use a heat source and a temperature detector and to control the heating of the heat source by using the temperature detector in different manners for low ambient temperatures and for high humidities, thereby minimizing the necessary capacity of the heat source to prevent burning of the machine parts and to enhance the safety of the countermeasure for these ambient conditions.

It is also an object of the present invention to enable different countermeasures to be taken during the inoperative condition and during the operative condition of the copying machine, with the heating of other members in the machine taken into account, thereby minimizing the power consumption and enhancing the safety.

The invention will become more fully apparent from the following detailed description thereof taken in conjunction with the accompanying drawings.

DESCRIPTION OF THE PREFERRED EMBODIMENTS

Figure 1:
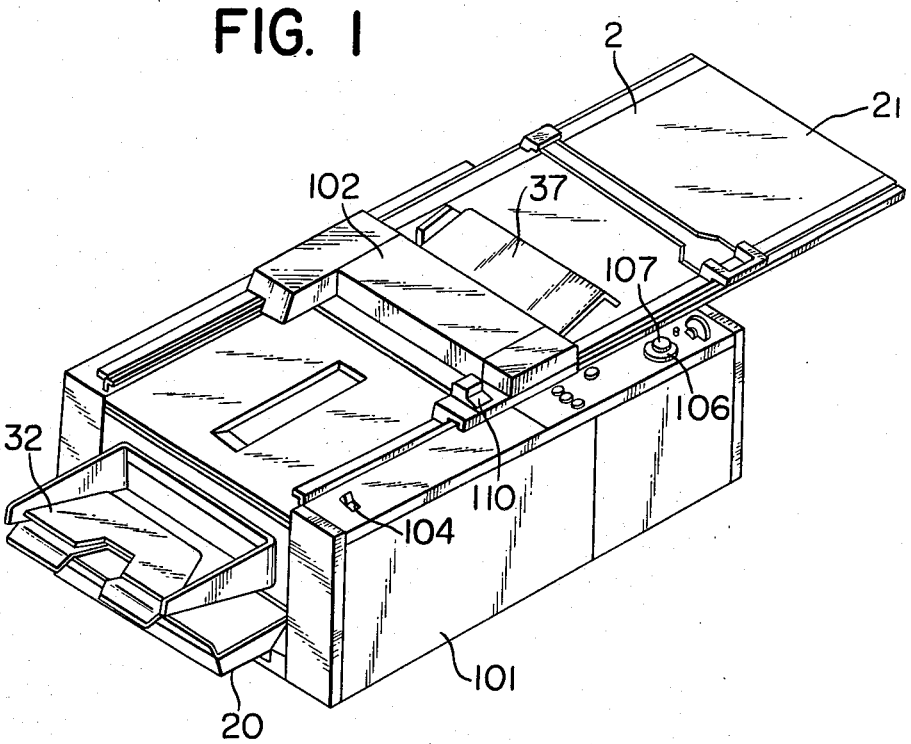
FIG. 1 is a pictorial perspective view of an electrophotographic copying machine to which the present invention is applied.
Figure 2:
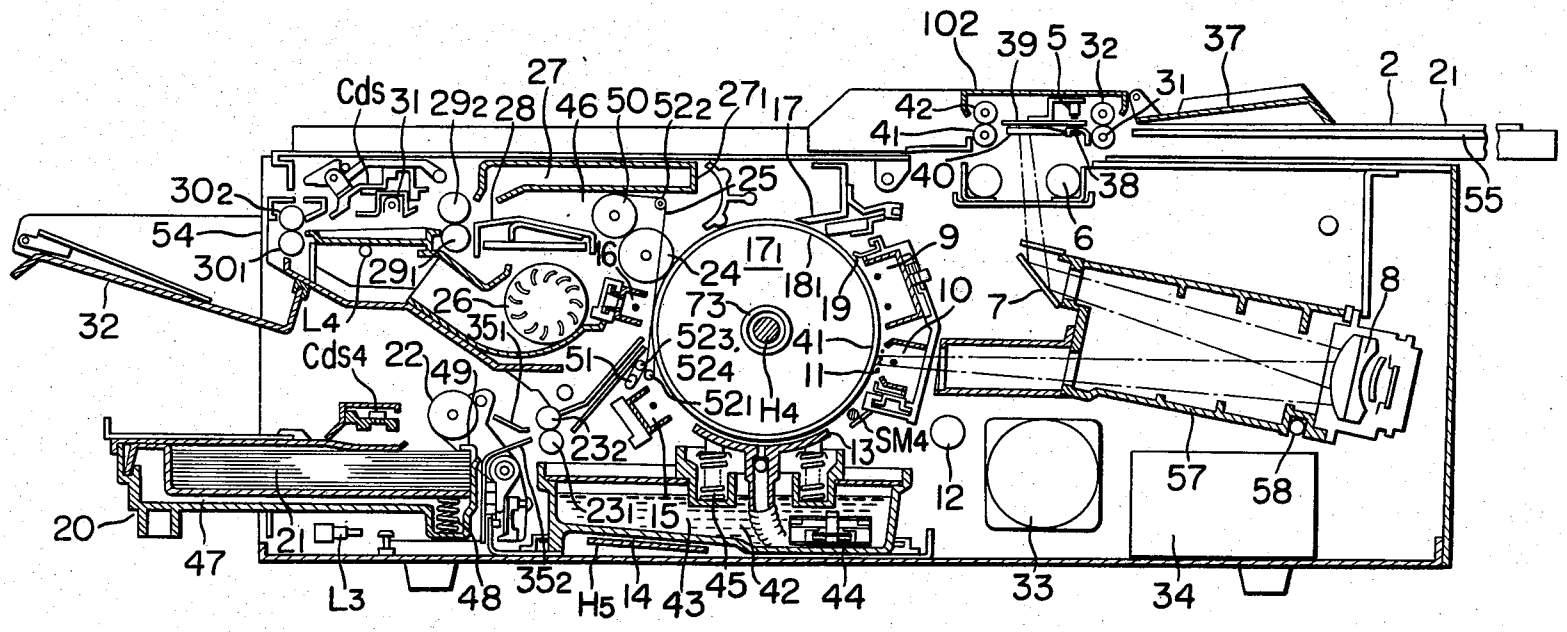

FIGS. 1 and 2 show an example of the electrophotographic copying machine to which the present invention is applicable and which may be used for copying either one of sheet originals and thick originals such as books, magazines, etc. FIG. 1 is a pictorial perspective view of the machine and FIG. 2 illustrates the operating mechanism thereof.

Reference will first be had to FIG. 2 to describe the operation of this copying machine with respect to the case where a sheet original is to be copied. A sheet original, when inserted between rollers 31 and 32 in a sheet original transport section 37 which rollers are rotating in synchronism with a photosensitive drum $17_1$, is transported leftwardly as viewed in FIG. 2. When the leading end edge of the sheet original is detected by a lamp 5 and a light-sensing element 38, the rollers 31 and 32 are temporally stopped and accordingly, the sheet original also comes to a halt. Next, when the photosensitive drum $17_1$ reaches a predetermined position, the rollers 31 and 32 resume their rotations to transport the original again leftwardly and thus, the original is discharged to the upper portion of the machine body by rollers 41 and 42. The original is illuminated by two lamps 6 in an illuminating section $40_1$ as it passes over an original carriage glass 40. The image of the original is directed via a mirror 7 and a mirror lens 8 and focused on the surface of the photosensitive medium in an exposure section 41.

The photosensitive drum $17_1$ has a photosensitive medium $18_1$ therearound and a heat source $H_4$ at the center thereof for heating the photosensitive medium. The photosensitive medium $18_1$ comprises a conductive layer, a photoconductive layer overlaid on the conductive layer and a transparent insulative layer covering the photoconductive layer. The photosensitive drum $17_1$ is rotated in the direction as indicated in FIG. 2. The photosensitive medium $18_1$ is first charged to the positive polarity by a primary charger 9 and when it arrives at the exposure section 41, it is subjected to the light image from the illuminating section $40_1$ and simultaneously therewith, to AC discharge from an AC discharger 10. The photosensitive medium is subsequently subjected to overall exposure by a lamp 12 to have an electrostatic latent image formed on the surface of the photosensitive drum, whereafter the photosensitive medium enters a developing device 43. The developing device 43 has a heat source H5 disposed in intimate contact with the bottom thereof, and developing liquid 42 is maintained at a temperature of at least 10° C., usually 20° to 30° C., by the heat source H5. The temperature of the developing liquid and of the photosensitive medium is controlled by a thermoswitch SM4 as will further be described, but an element for detecting the temperature of the developing liquid may be provided separately. The developing device 43 comprises a vessel 14 for containing the developing liquid 42, a pump 44 for agitating and forcing up the developing liquid, and a developing electrode 13 which is adapted to be urged toward the photosensitive drum $17_1$ always with a minute clearance maintained between the electrode and the drum. The electrostatic latent image formed on the photosensitive drum $17_1$ is developed into a visible image by the developing liquid 42. The photosensitive drum surface is then charged to a negative polarity by a post-charger 15 to squeeze out any excess developing liquid on the photosensitive drum $17_1$ without the image being disturbed. Subsequently, a sheet of transfer paper 21 fed from the paper feed section is brought into intimate contact with the photosensitive drum $17_1$ and charged to a positive polarity by a transfer charger 16, whereafter the image on the photosensitive drum $17_1$ is transferred onto the transfer paper 21. After the image transfer has been completed, the transfer paper 21 is separated by a separating belt 25 and directed to a drying-fixing section 46. The photosensitive drum $17_1$ is wiped by the edge portion of a blade cleaner 18 to remove any residual toner or developing liquid therefrom so that it may be ready for reuse in the next cycle. On the other hand, the stock of transfer paper 21 is contained in a cassette 20 which is removably mounted in the paper feed section located downwardly and leftwardly of the machine body. Various sizes of cassette corresponding to the various sizes of transfer paper are prepared and may easily be replaced by one another as required. The stock of transfer paper 21 rests on an intermediate plate 47 within the cassette 20, and is normally urged against separator pawls 49 on the opposite sides of the forward end of the cassette by the intermediate plate 47 being upwardly biased by a spring 48.

As soon as the photosensitive drum $17_1$ reaches its predetermined position, a signal is produced to lower a normally rotating paper feed roller 22 into engagement with the uppermost sheet of transfer paper 21 in the cassette 20, and the paper feed roller cooperates with the separator pawls 49 to separate the uppermost sheet of transfer paper 21 from the rest of the paper stock and feed it from the cassette 20 in the direction as indicated in FIG. 2. Since, however, register rollers $23_1$ and $23_2$ closely adjacent to the paper feed section have been stopped from rotating immediately after the paper feed roller 22 has been lowered, the transfer paper 24 fed out of the cassette forms a slack between guides $35_1$ and $35_2$ with the leading end edge thereof striking against the nip between the register rollers $23_1$ and $23_2$. Immediately thereafter, the photosensitive drum $17_1$ produces a paper feed start signal, by which the register rollers $23_1$ and $23_2$ are rotated to transport the transfer paper 21 at a speed coincident with the peripheral speed of the photosensitive drum $17_1$. On the other hand, the paper feed roller 22 is again lifted out of engagement with the stock of transfer paper 21 in a predetermined time after it has been lowered, and the paper transport thereafter is performed by the register rollers $23_1$ and $23_2$ and subsequent paper transport means.

A separator belt 25 which is in the form of a thin endless belt extends over a separator roller 24, deflection pulleys 50, 51, and pulleys $52_1$, $52_2$, $52_3$. That portion of the belt between the pulley $52_3$ and the separator roller 24 bears against the drum $17_1$ at a point corresponding to the leading end edge of the transfer paper, and that portion of the belt between the pulleys $52_1$ and $52_2$ is caused to pass along a path deviated from the passageway of the transfer paper, by the action of the deflection pulleys 50, 51. In the image transfer step during which the transfer paper 25 is maintained in intimate contact with the photosensitive drum $17_1$, one side edge of the transfer paper holds the separator belt 25 between itself and the drum. Thus, by the separator belt 25 being separated from the photosensitive drum $17_1$ by the separator roller 24, the transfer paper 21 which is in intimate contact with the photosensitive drum has the one side edge thereof forced away from the latter. The transfer paper, when the one side edge thereof has been so forced away from the drum, is completely separated from the photosensitive drum $17_1$ by the self-supporting strength of the transfer paper itself and by the force of the wind blowing from a duct 27 through an air outlet $27_1$ so that the transfer paper is transported to the drying-fixing section 46.

In the drying-fixing section 46, the unfixed transfer paper 21 is transported leftwardly by a roller 24, as viewed in FIG. 2, and intensely heated at 180° to 200° C. just beneath a heater 28 and dried and fixed by the wind blowing from the duct 27. Most of the air heated by the heater 28 and used for the drying is sucked into a block 26 through an inlet port provided below the heater 28. The transfer paper 21 thus dried and fixed is subjected to the discharge from a discharger 31 for removal of any charge remaining on the surface of the paper, whereafter the transfer paper is directed from discharge rollers $30_1$, $30_2$ to a discharge port 54 and thence onto a tray 32.

Operation will now be described with respect to the case where a book original is to be copied. Change-over of the copying machine from the sheet original copy mode to the book original copy mode may be accomplished by depressing a change-over button 110 in FIG. 1 to move the original carriage 2 in the direction, as indicated in FIG. 2, i.e. from the sheet original copy position to the book original copy position, thereby cutting off the electrical power supply to a sheet original transport section and thus changing over all the circuits to the book original copy mode. The book original copy position is such that the forward end of the book original, namely, the forward end of the original carriage glass 55, lies at the location which was occupied by the lamp 5 and light-sensing element 38 during the sheet-original copy position.

The book original to be copied is placed on the carriage glass 55 with the forward end thereof registered to the forward end of the glass, and then a copy button 107 is depressed with the book original held down by a keep cover 2, whereby an original start signal identical with that in the sheet original copy mode is produced to move the original carriage 2 leftwardly, as viewed in FIG. 2, in synchronism with the peripheral speed of the photosensitive drum $17_1$, thereby effecting slit exposure. When the exposure is completed, the original carriage 2 is caused to stop its leftward movement by a signal from the photosensitive drum and immediately moved back or rightwardly. The speed of this backward movement is higher than that of the forward movement so that the copying efficiency is enhanced. Upon return of the original carriage to its initial position for the book original copy mode, the drive to the carriage is stopped.

In the other points than what has been described above, the operation is similar to that described with respect to the sheet original copy mode.

Figure 3:
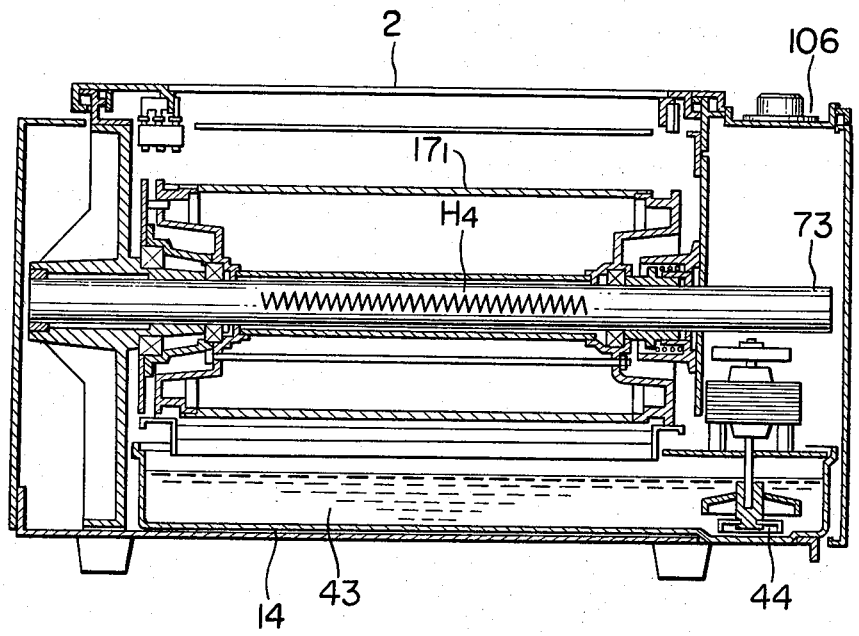
FIGS. 2 and 3 show an arrangement of the heat source and the temperature detector means in the copying machine of FIG. 1.

In short, the present embodiment employs, in the copying machine as described above, a heat source 4 formed of 40 W nichrome wire provided within the drum shaft 73 (FIG. 3) of the photosensitive drum $17_1$ and a thermoswitch SM4 provided at a location along the periphery of the photosensitive drum $17_1$ for detecting the temperature of the photosensitive medium $18_1$. Supply of the current to the nichrome wire is controlled by the thermoswitch SM4 and main switch 104, as will further be described, so that the photosensitive medium $18_1$ may retain at least a minimum necessary temperature and that the photosensitive medium may not absorb humidity even if the photosensitive medium or its environment is at a normal temperature. The heat from the nichrome wire is readily conducted through the aluminum of the drum and the conductive layer of the photosensitive medium to heat the latter. The so heated photosensitive medium in turn warms up the vicinity of the surrounding chargers 9, 10, 15, 16 and also warms up the developing liquid 42 through the electrode 13.

Furthermore, the thermoswitch SM4 provided near the developing device 43 is also utilized to control the heating of the heater H5 nichrome wire or the like at the bottom of the developing device 43 so that the developing liquid may retain its temperature without evaporating (as will further be described).

The location whereat the heat source H4 in the present embodiment is situated is effective to heat the photosensitive medium over its entire area, and particularly so during inoperative condition of the copying machine.

Figure 4:
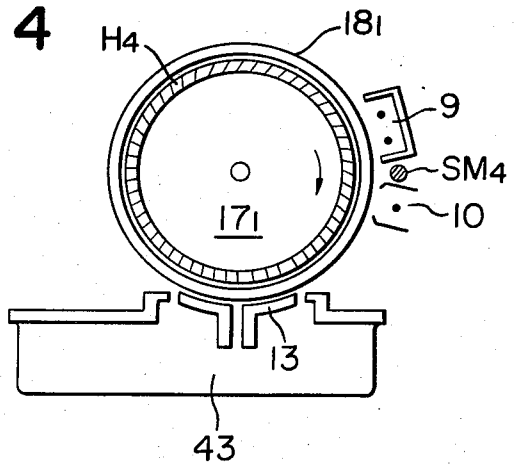

FIG. 4 shows another arrangement of the heat source H4 and thermoswitch SM4 wherein nichrome wire is stretched along the inner periphery of the photosensitive medium $18_1$ with an insulator interposed therebetween so that the photosensitive medium may be heated efficiently. Also, the thermoswitch SM4 provided near the charger enables the heating of the heat source H4 to be controlled with the atmosphere around the corona discharge area taken into consideration.

Figure 5:
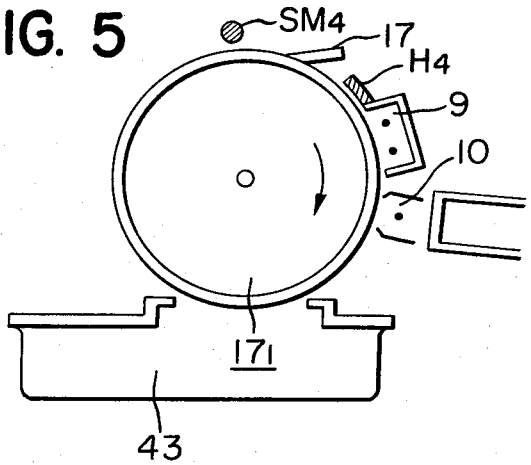
FIGS. 4 and 5 show another arrangement of the heat source and the temperature detector means according to the present invention.

If, as shown in FIG. 5, the heat source is disposed just in front of and closely adjacent to the primary charger 9 or the AC discharger 10, the environment of the photosensitive medium and the charger may be corrected immediately before the latent image formation. In this case, the thermoswitch SM4 may be disposed above the photosensitive medium and before the cleaning means to thereby reduce the direct influence of the heat source.

The heat source and the thermoswitch will be the more effective if they are extensive enough to cover the recording width of the photosensitive medium, but alternatively they may be disposed so as to correspond to the recording portion of the photosensitive medium.

During operative condition of the copying machine, the heat source may also be provided by controlling the temperature of the hot wind from the blower to the block 26 used for the fixation and supplying it to the interior of the perimeter of the drum.

Figure 6:
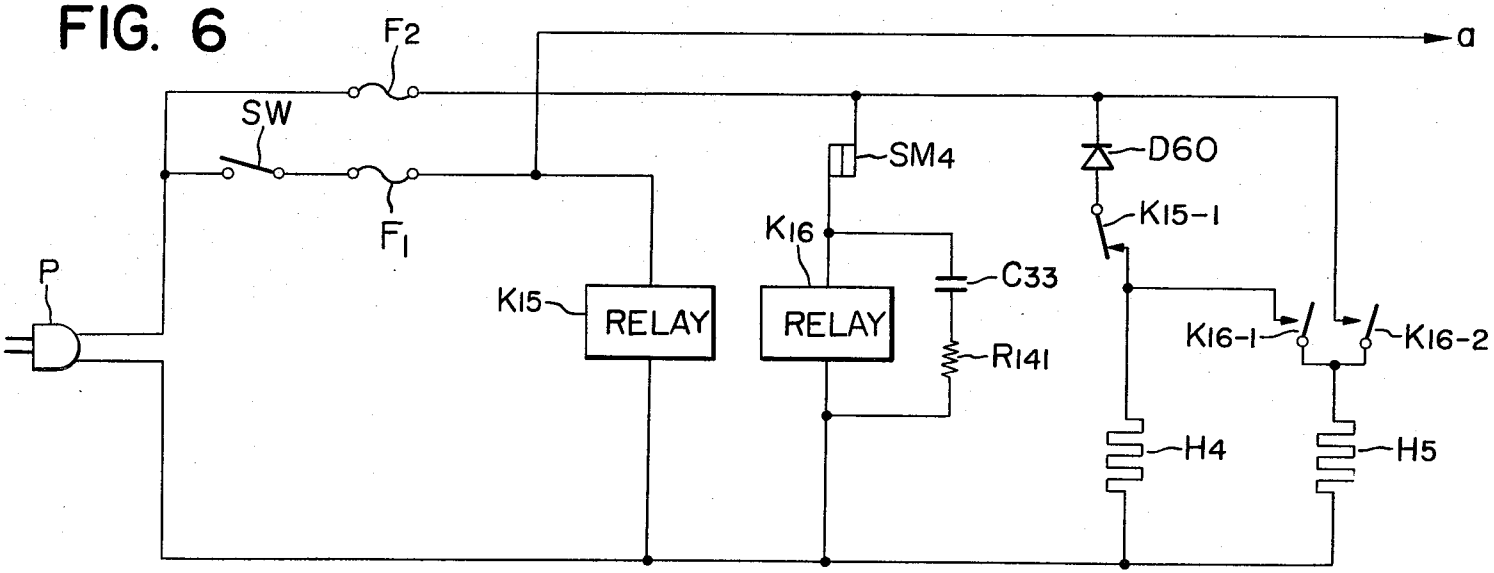
FIG. 6 is a diagram showing an example of the circuit for the temperature control means in the temperature and humidity compensating device of the present invention.

FIG. 6 illustrates an example of a control circuit for controlling the heating of the heat source H4 in the present invention. This circuit serves to maintain the photosensitive medium and its environment at a temperature of at least 15° C. and in addition, to make the temperature of the photosensitive medium somewhat higher than that of the environment in order to prevent the photosensitive medium from absorbing moisture even if the environment is at 15° C. or higher temperature and accordingly at a high humidity. Further, the circuit utilizes the same temperature detector element to maintain the temperature of the developing liquid. Moreover, the circuit is effective to minimize the heating for the prevention of moisture absorption with the normal temperature condition of the environment taken into account, and also in accordance with the operative condition of the copying machine.

Describing the circuit, the voltage from a power source plug P is applied to the heat source H4 either through a fuse F2 and diode D60 and contact K15-1 or through the fuse F2 and contacts K16-1, K16-2, and applied to the heat source H5 either through the contact K16-2 or through the diode D60 and contacts K15-1, K16-1. The contact K15-1 is adapted to be opened by a relay K15 energizable through switch SW and fuse F1, and the contacts K16-1, K16-2 are adapted to be closed by a relay K16 energizable through fuse F2 and thermoswitch SM4. The switch SW is for operating the other portion of the machine as shown in FIG. 2, and the thermoswitch SM4 is provided near the developing electrode 13 and the photosensitive medium $\mathbf{18}_1$ in FIG. 2 and serves to detect the temperature of the photosensitive medium $\mathbf{18}_1$.

Assuming that the temperature within the machine is below the normal temperature of 15° C., the thermoswitch SM4 remains closed. Therefore, irrespective of the open or the closed position of the switch SW, the relay K16 is energized to close the contacts K16-1 and K16-2 to permit a current (power of 40 W)to the heat sources H4 and H5. Thus, independently of the operative or the inoperative condition of the machine, the photosensitive medium 17 and the developing liquid 42 are heated up to the normal temperature, whereby the photosensitive medium is maintained at at least its minimum necessary temperature. When the temperature within the machine is above 15° C., the thermoswitch SM4 is opened so that the contacts K16-1 and K16-2 pertaining to the relay K-16 are opened. Even in this case, however, when the switch SW is opened, namely, the machine is in its inoperative condition, the relay K15 is not energized and thus, half-wave (power of 20 W) current flowing for a temperature below 15° C. is supplied to the heat source H4 through the diode D60 and the contact K15-1. As a result, the photosensitive medium is somewhat heated and maintained at a level above the ambient temperature.

Consequently, some heating is maintained even if the environment is at the normal temperature and thus, any moisture absorption during high humidity condition may conveniently be prevented without the other devices or parts being overheated.

As soon as the switch SW is closed to operate the copying machine through a line a, the contact K15-1 is opened to cut off the supply of half-wave current to the heat source H4. By this, the photosensitive medium is prevented from being heated for moisture absorption by the heat from the other parts in the machine and also prevented from unnecessarily increasing the temperature within the machine.

Instead of the diode D60, a known phase control circuit comprising a thyristor or the like may be used to change the power from the source into a power more or less than ½ and supply such power to the heat source H4.

Also, the power supplied for the heat-retention of the photosensitive medium may be controlled in accordance with temperature.

In brief, the heating control for the heat-retention of the photosensitive medium is made to differ from the heating control for preventing moisture absorption by the photosensitive medium, whereby the photosensitive medium retains its heat at a level somewhat higher than the ambient temperature.

The switch SW for deenergizing the moisture absorption prevention heating may be synchronized with either the closing of the main switch (104 in FIG. 1) of the copying machine or the closing of the copy start switch. Also, the switch SW may be means for eliminating the maximum temperature (which would cause burning of the photosensitive medium and evaporation of the developing liquid).

Figure 7:
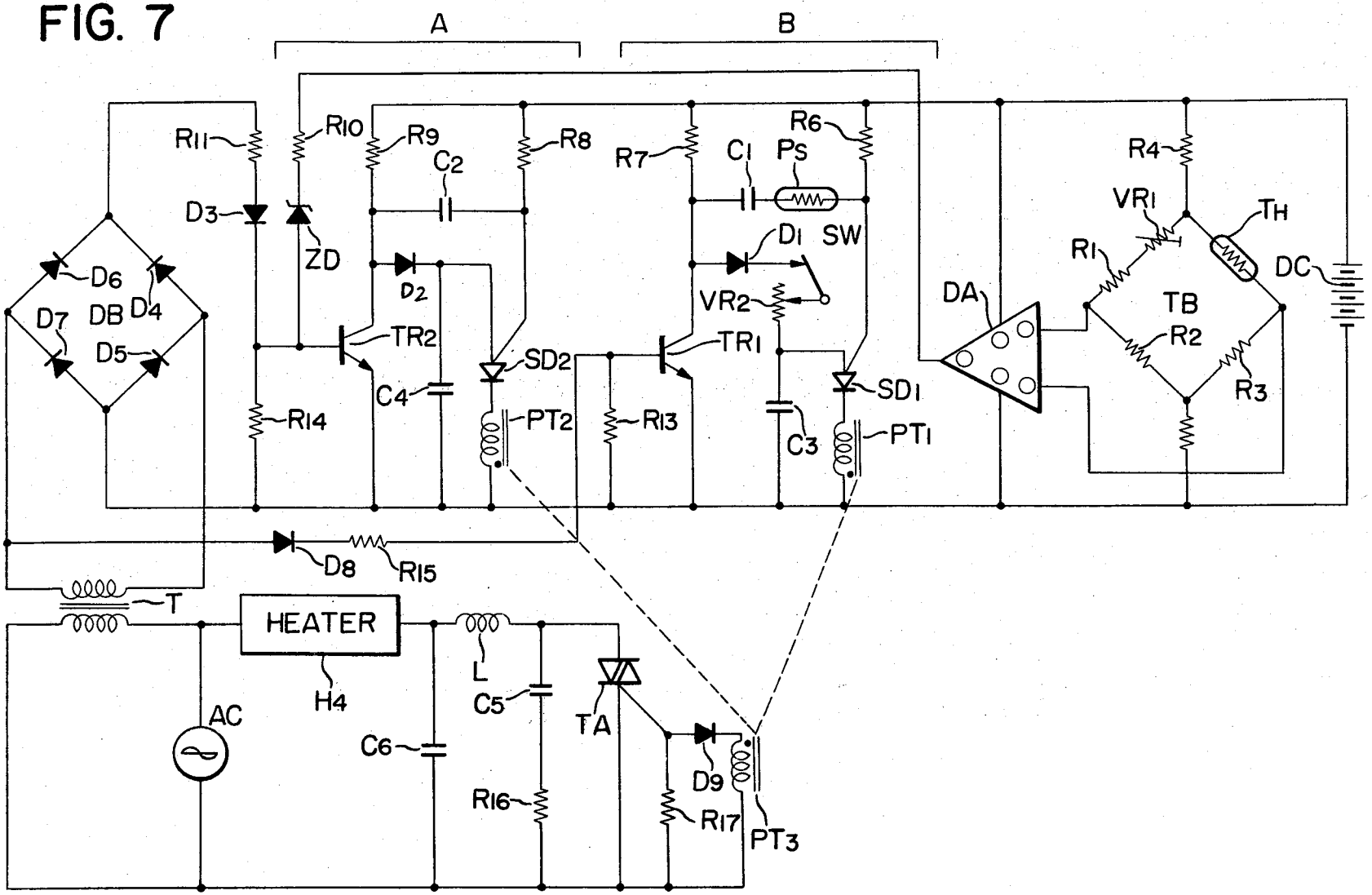
FIG. 7 is a diagram showing another example of the circuit for the heat control means in the present invention.

FIG. 7 illustrates another example of a heating control circuit. In this circuit, AC full wave power is supplied to the heat source H4 through a circuit portion A to maintain the photosensitive medium at a temperature about 10° C. and an AC half-wave power or a half-wave power at every several periods is supplied to the heat source H4 through a circuit portion B in accordance with the ambient temperature to maintain the temperature of the photosensitive medium at a level above the ambient temperature and thereby prevent the photosensitive medium from absorbing any moisture. This circuit portion B can vary the supplied power in the manner as shown in FIG. 8B, C and D, thereby enabling finer countermeasures to be achieved. In addition, it substantially eliminates noise during the power supply.

Describing the circuit, the AC component from the alternating power source AC is rectified by a diode D8 and the rectified output is divided by resistors R15 and R13 and applied to the base of a transistor TR1. Also, the full-wave rectified output from a diode bridge DB is divided by resistors R11 and R14 and applied to the base of a transistor TR2.

The circuit portion B will be described more particularly. The collector of the transistor TR1 is connected to a reference potential source DC through a diode D1, switch SW, resistor VR2 and capacitor C3, and a switching diode SD1 has its cathode connected to the junction between a resistor VR2 and a capacitor C3 and has its anode connected to the reference potential source DC through a pulse transformer PT1.

Resistors R7 and R6 are connected between the collector of the transistor TR1 and the power source DC and between the gate of the diode SD1 and the power source DC, respectively, and a capacitor C1 and a thermistor $P_S$ of positive characteristic are serially inserted between the collector of the transistor TR1 and the gate of the diode SD1. The thermistor $P_S$ is provided to detect the ambient temperature. The heater H4 is connected to one terminal of the alternating power source AC, and a triac TA is connected to one end of the heater H4 through a filter comprising capacitors C3, C6 and coil L. The gate of the triac is connected to a pulse transformer PT3 through a diode D9.

The pulse transformer is also inductively coupled to the pulse transformer PT1 and thus, a driving power is applied to the heater H4 for a time from after a pulse has been applied to the pulse transformer PT3 until the alternating power source assumes zero potential, that is, substantially during a half period.

The circuit portion A is similar in construction to the circuit portion B. However, the base of the transistor TR2 is connected to the output terminal of a differential amplifier DA through a Zener diode ZD and a resistor R10, and the input terminal of the differential amplifier is in turn connected to a bridge TB including a thermistor TH for detecting the temperature of the photosensitive medium (the thermistor TH being arranged in the same manner as the aforesaid thermistor SM4). A capacitor C4 is connected to the collector of the transistor TR2 directly through a diode D2, and a capacitor C2 is directly connected to the gate of a switching diode SD2. The pulse transformer PT2 is inductively coupled to the pulse transformer PT3.

Now, referring to FIG. 7, a voltage which is half-wave rectified by the bridge circuit DB and divided by resistors R15 and R13, is applied to the base of the transistor TR1. By the threshold voltage of the transistor TR1, the collector thereof is enabled to provide a pulse output P in the vicinity of zero potential of the rectified output. Such pulse output is passed through the diode D1 and resistor VR2 to the capacitor C3 to charge up the terminal voltage thereof to a level E1. After the arrival of such pulse P1, the collector potential becomes null and permits a current to flow through the resistor R7, resistor R6, thermistor $P_S$ and capacitor C1. Thus, a voltage EG derived from the voltage division by the resistor R6 and thermistor $P_S$ is applied to the gate of the switching diode SD1, but if it is assumed that the voltage EG is in the relation that $E1<EG$, the charge in the capacitor C3 remains unchanged till the arrival of the next pulse P2, and the capacitor C3 is again charged up only upon the arrival of the next pulse P2, thus assuming a potential E2. Thereafter, the collector potential again becomes null and, if it is assumed that the relation $E2>EG$ is brought about upon application of said divisional voltage EG to the gate of the switching diode SD1, the charge stored in the capacitor C3 is discharged through the switching diode SD1 to generate a pulse. Such pulse is passed through the pulse transformers PT1 and PT3 to drive the triac TA, whereby the driving current as shown in FIG. 8B is supplied to the heater H4.

If the ambient temperature then rises, the resistance value of the thermistor $P_S$ will be increased to boost the voltage EG and therefore, no discharge pulse will be generated unless said zero point pulse P arrives several times. Likewise, if the resistance value of the resistor VR2 is manually increased, the charge-up voltage E for the capacitor C3 will be low and thus, no discharge pulse will be generated unless the pulse P arrives several times.

As a result, a small current as shown in FIG. 8C or D is supplied to the heat source in accordance with the ambient temperature and the set resistance values. Conversely, if these resistance values are reduced, the voltage E for the capacitor C3 satisfies the relation that $E>EG$ at each arrival of the zero point pulse P, so that discharge pulse is generated each time the pulse P arrives and the heat source H4 is supplied with the full-wave voltage as shown in FIG. 8A. It will thus be apparent that the output of the circuit portion A supplies the heat source H4 with a sufficient full power to permit the photosensitive medium to retain its heat.

The above-described operation of the circuit portion A takes place when the output of the amplifier DA is below the Zener voltage of the Zener diode ZD, and such output is produced when the thermistor TH detects a very much lower temperature than 10° C.

The operation of the circuit portion B is so controlled that, even after its heat retention, the photosensitive medium absorbs no moisture and yet the temperature of the photosensitive medium is safely above the ambient temperature. More specifically, the circuit portion B is operated by the switch SW only before the copying machine is operated and moreover, it varies the moisture-absorption prevention device power in accordance with the ambient temperature, thus preventing overheating of the machine parts even during a long-time power supply and avoiding wasteful power consumption.

In addition, the supply of small power for the prevention of moisture absorption and the change-over of the power supply take place in synchronism with the zero point of AC voltage and this eliminates any noise that would otherwise be imparted to nearby radios or the like when power supply control continues for a long time.

Figure 10:
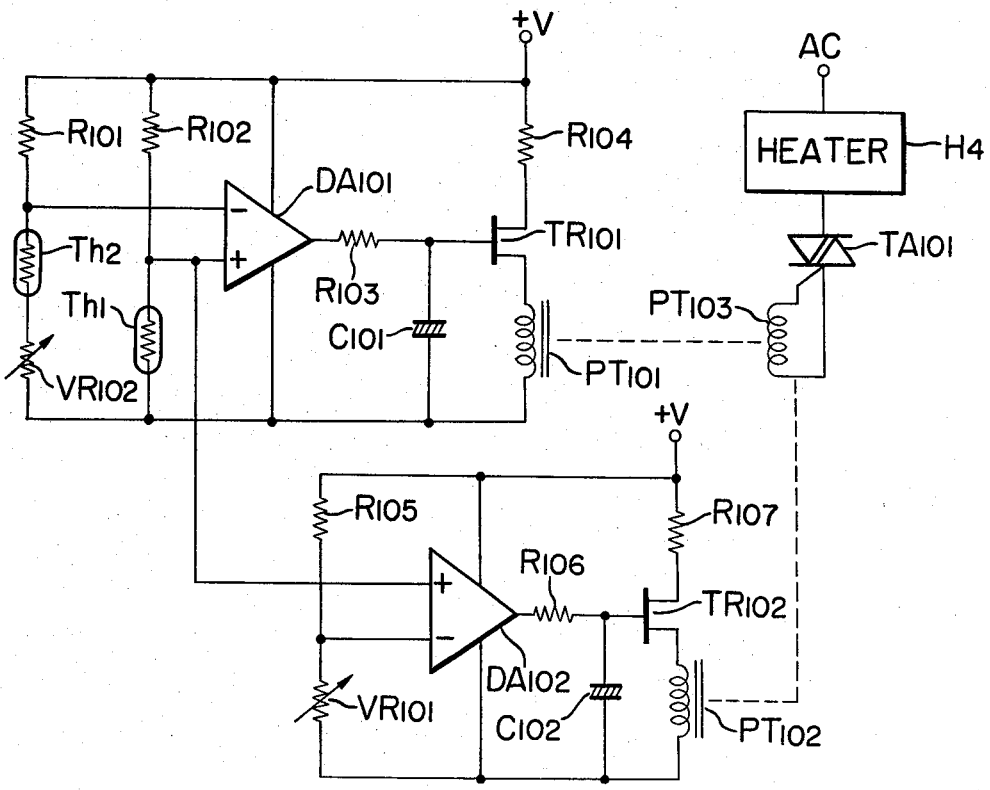
FIG. 10 is a diagram of the circuit for the heat control means in the embodiment of FIG. 9.
Figure 9:
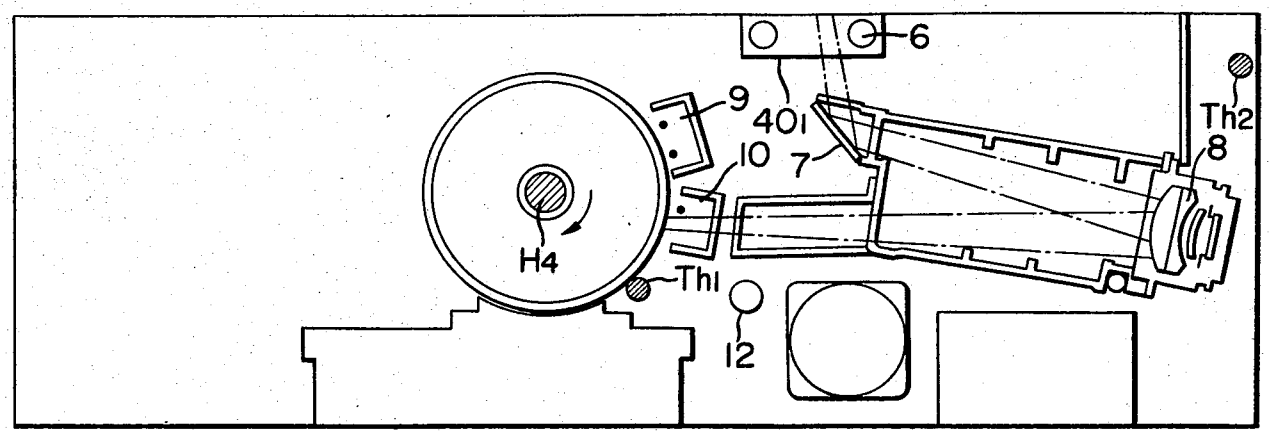
FIG. 9 shows an arrangement of the heat source and the temperature detector means in another embodiment of the device according to the present invention.

FIGS. 9 and 10 illustrate another embodiment of the temperature and humidity compensating device according to the present invention.

This embodiment is such that the temperature of the photosensitive medium is compared with the ambient temperature to detect the difference therebetween and, when the former is lower by a predetermined value than the latter, the heat source is energized to heat for the prevention of moisture absorption but, when the photosensitive medium is at a minimum temperature, the heat source is caused to heat for purposes of heat-retaining.

FIG. 9 is a schematic view in which two thermistors $Th_1$ and $Th_2$ are disposed, one adjacent to the photosensitive medium and the other remotely from the heating member (heating-fixing device or the like) of the copying machine. The arrangement shown there is similar to that of FIG. 2 in the other points.

FIG. 10 is a diagram of the heating control circuit for the heat source H4, in which one input terminal of a differential amplifier DA101 is connected to the thermistors $Th_1$ and $Th_2$ and the output terminal of the amplifier DA101 is connected through a resistor R103 to the emitter of a switching transistor TR101. The first emitter of the switching transistor TR101 is connected through a resistor R104 to a reference voltage source V and the second emitter of the switching transistor TR101 is connected to a pulse transformer PT101. One of the input terminals of a differential amplifier DA102 is connected to the thermistor $Th_1$ and the other input terminal is connected to a comparator resistor VR101 for detecting the minimum temperature. The output terminal of the amplifier DA102 is connected through a resistor R106 to the emitter of the switching transistor TR102. The first emitter of the switching transistor TR102 is connected through a resistor R107 to the reference voltage source V, and the second emitter of the switching transistor TR102 is connected to a pulse transformer PT102. The pulse transformer PT101 and PT102 are inductively connected to a pulse transformer PT103, which is in turn connected to the gate of a triac TA101 which is also connected through the heat source H4 to an alternating voltage source AC.

Operation of the present embodiment will now be described. When the temperature of the photosensitive medium is low and below 10° C. and when the resistance value of the thermistor $Th_1$ becomes higher than the comparison value of the resistor VR 101, the amplifier DA102 produces its output. This output triggers the oscillation circuit comprising the resistor 106, capacitor 102 and switching transistor TR102, so that the pulse transformer PT102 generates a pulse of short interval which renders the triac TA101 conductive to permit supply of AC power to the heat source H4. When the photosensitive medium attains a predetermined temperature 10° C., the output of the differential amplifier DA102 disappears to cease the oscillation and discontinue the power supply to the heat source H4. In this manner, the minimum necessary temperature of the photosensitive medium is always ensured.

When the temperature of the photosensitive medium is lower than the ambient temperature, namely, when the input voltage to the differential amplifier DA101 from the thermistor $Th_1$ is higher than the input voltage to the differential amplifier DA101 from the thermistor $Th_2$, the amplifier DA101 produces its output. The temperature difference between the photosensitive medium and the environment for which such output is produced is set by the reference resistor VR102. This output of the differential amplifier DA101 causes the switching transistor TR101 to generate an oscillating pulse in the same manner as described, so that the triac TA101 is rendered conductive by the pulse transformer PT101. Thus, AC power is supplied to the heat source H4. Accordingly, the photosensitive medium is heated to a temperature somewhat higher than the ambient temperature. When the temperature difference disappears, the output of the differential amplifier DA101 disappears to discontinue the power supply to the heat source H4. In this manner, even if the environment is at high temperature and high humidity, the photosensitive medium is prevented from absorbing moisture.

According to the present embodiment, as described above, the power supply to the same heat source is controlled by detecting the ambient temperature and this reduces the power consumption.

In this embodiment, if such a design is made as to stop the moisture-absorption prevention power supply to the heat source H4 (namely, to disconnect the terminal of the resistor R103) after the copying machine is started, the power consumption may further be reduced.

Furthermore, the heat source H4 disposed within the photosensitive drum causes the heat to spread from the inside, so that the temperature rise of the thermistor $Th_2$ is delayed with respect to that of the thermistor $Th_1$, thus preventing the heat source H4 from being unnecessarily left in an energized condition.

Figure 8:
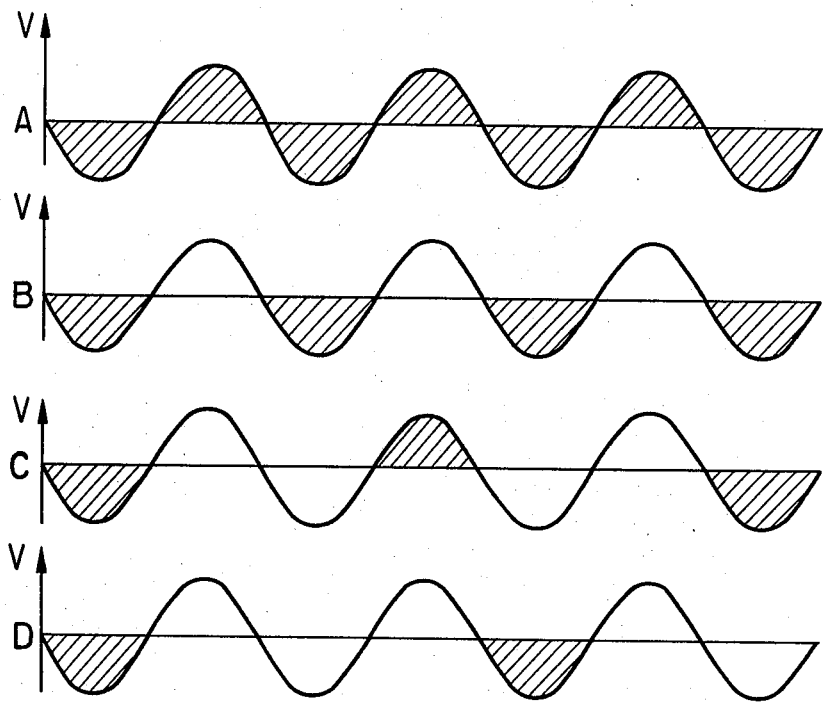
FIG. 8 illustrates the output waveforms in the FIG. 7 circuit.

Still furthermore, in the present embodiment, the quantity of power supplied for the prevention of moisture absorption is equal to the quantity of power supplied for the low temperature condition, whereas it may also be the partial quantity shown in FIG. 8 or a phase-controlled partial quantity.

It should be noted here that the aforementioned differential amplifiers DA101 and DA102 can be also designed to continuously derive their outputs in accordance with the difference between the photosensitive medium temperature and ambient temperature. Furthermore, the above-mentioned invention may be modified in design such that the differential amplifier permits a supply of current flow to the heater when the photosensitive medium temperature is 1 to 2 centidegrees above the ambient temperature. In such case, however, when the photosensitive temperature is above the predetermined upper limit, the current supply to the heater is unconditionally stopped upon detection of the upper limit so that the apparatus may be safely prevented from damage such as burning.

What is claimed is:

1. An electrographic apparatus having a device for controlling the temperature of a photosensitive surface therein, comprising:
   - a photosensitive medium having a photoconductive layer;
   - means for forming an electrostatic latent image on a surface of said photosensitive medium;
   - a heat source disposed near said photosensitive medium so as to heat the latter;
   - temperature detector means disposed remotely from said heat source for detecting the temperature of said photosensitive medium; and
   - control means for controlling the heating of said heat source so that the temperature on the surface of said photosensitive medium detected by said detector means is not lower than the ambient temperature thereof wherein the temperature of said photosensitive medium is controlled to prevent moisture absorption thereby permitting normal image formation to occur, wherein said control means includes first power supply means for supplying a predetermined power to said heat source when the temperature detected by said detector means is below a predetermined level, and second power supply means for supplying to said heat source a power less than said predetermined power when said detected temperature reaches the predetermined level.

2. An electrographic apparatus according to claim 1, further comprising means for interrupting the supply of power to said heat source by said second power supply means after said image forming means starts to operate.

3. An electrographic apparatus having a device for controlling the temperature of a photosensitive surface therein, comprising:
   - a photosensitive medium having a photoconductive layer;
   - means for forming an electrostatic latent image on a surface of said photosensitive medium;
   - a heat source for heating said medium;
   - first and second detector means for detecting the temperature of said photosensitive medium, wherein said second detector means is disposed at a location spaced from that of said first detector means; and
   - control means responsive to said first and second detector means to cause heating of said heat source at least when the temperature detected by said first detector means is lower than the temperature detected by said second detector means wherein said photosensitive medium is controlled to prevent moisture absorption.

4. An electrographic apparatus according to claim 3, further comprising means for causing said heat source to heat independently of said second detector means when the temperature detected by said first detector means is below a minimum predetermined temperature.

5. An electrographic apparatus having a device for controlling the temperature of a photosensitive surface therein, comprising:

a photosensitive medium having a photoconductive layer, wherein said photosensitive medium is mounted on a circulative member so as to be reusable;

means for forming an electrostatic latent image on a surface of said photosensitive medium;

a heat source disposed inside said circulative member so as to heat the latter;

temperature detector means;

control means for controlling the heating of said heat source in accordance with the temperature detected by said detector means so that the temperature on the surface of said photosensitive medium is not lower than the ambient temperature thereof, wherein the temperature of said photosensitive medium is controlled to prevent moisture absorption thereby permitting normal image formation to occur; and wherein said control means includes first power supply means for supplying a predetermined power to said heat source when the temperature detected by said detector means is below a predetermined level, and second power supply means for supplying to said heat source a power less than said predetermined power when said detected temperature reaches the predetermined level.

6. An electrographic apparatus according to claim 5, further comprising means for interrupting the supply of power to said heat source by said second power supply means after said image forming means starts to operate.

7. An electrographic apparatus having a device for controlling the temperature of a photosensitive surface therein, comprising:

a rotatable photosensitive medium having a photoconductive layer;

means for forming an electrostatic latent image on a surface of said rotatable photosensitive medium;

a heat source disposed inside of said rotatable photosensitive medium so as to uniformly heat the surface of said photosensitive medium;

a first power supplying means for supplying power to the apparatus including a first interrupting means for interrupting the power supply when an overcurrent takes place, and a main power switch for manually switching the power supplying means;

a second power supplying means for supplying power to said heat source at least prior to actuation of said main power switch including a second interrupting means for interrupting the power supply to said heat source when an overcurrent takes place; and an electrical power plug connected to said first and second power supplying means.

8. An electrographic apparatus according to claim 7, wherein said photosensitive medium is drum shaped and is supported with a shaft, and wherein said heat source is positioned within said shaft.

9. An electrographic apparatus according to claim 20, wherein said photosensitive medium is drum shaped and said heat source is disposed at the inner periphery of said drum shaped photosensitive medium.

10. An electrographic apparatus having a device for controlling the temperature of a photosensitive surface therein, comprising:

a rotatable photosensitive medium having a photoconductive layer;

means for forming an electrostatic latent image on a surface of said rotatable photosensitive medium;

a heat source disposed inside of said rotatable photosensitive medium so as to uniformly heat the recording area of said rotatable photosensitive medium;

means for supplying power to said heat source; and control means for controlling said power supply means during operational and non-operational conditions of said apparatus, thereby controlling the heating of said heat source during said conditions.

11. An electrographic apparatus according to claim 10, wherein said drum shaped photosensitive medium is supported with a shaft, and said heat source is positioned within said shaft.

12. An electrographic apparatus according to claim 10, wherein said heat source is disposed at the inner periphery of said drum shaped photosensitive medium.

13. An electrographic apparatus according to claim 10, wherein said power supply control means, during operational conditions of said apparatus, switches between a first predetermined power and zero power; and, during non-operational conditions of said control means, switches between the first predetermined power and a second power less than said first predetermined power.

14. An electrographic apparatus according to claim 10, wherein the switching by said power supply control means depends on the operation of a main power switch of said apparatus.

15. An electrographic apparatus having a device for controlling the termperature of image forming members comprising:

a first heating means for heating one of said image forming members;

a second heating means for heating another one of said image forming members;

power supplying means;

a main power switch for connecting said power supplying means to said apparatus; and control means for differentiating between a heating mode of said first heating means and a different heating mode of said second heating means when said main switch is in a predetermined condition.

16. An electrographic apparatus according to claim 15, wherein said first heating means serves to heat a photosensitive member and said second heating means serves to heat a developer.

17. An electrographic apparatus according to claim 15, wherein before turning on of said main switch, during the heating mode of said first heating means, a first power or a power less than said first power is supplied to said first heating means, and during the heating mode of said second heating means, a second power or zero power is supplied to said second heating means.

18. An electrophotographic apparatus having a device for controlling the temperature of image forming members comprising:

a first heating means for heating one of said image forming members in a first heat mode;

a second heating means for heating another of said image forming members in a second heat mode;

temperature detecting means;

control means for controlling the heat modes of said first and second heating means in accordance with the temperature detected by said temperature detecting means; and means for supplying AC power to said first and second heating means, and wherein said control means controls the heat modes of said first and second heating means in such a manner that said AC power supplying means selectively supplies a first magnitude of electrical power or a power less than said first magnitude to said first heating means in accordance with the temperature detected by said temperature detecting means, and selectively supplies a second magnitude of electrical power or zero power to said second heating means in accordance with the temperature detected by said temperature detecting means.

19. An electrographic apparatus according to claim 18, wherein said apparatus further comprises means for supplying AC power to said first and second heat means, and wherein said control means controls the heat modes of said first and second heat means in such a manner that said AC power supplying means selectively supplies a full rectified power component or a half rectified power component of the AC power to said first heat means in accordance with the temperature detected by said temperature detector means, and selectively supplies a full rectified power component of the AC power or zero power to said second heat means in accordance with the temperature detected by said temperature detector means.

* * * * *